US008582780B2

(12) United States Patent
Barnhill

(10) Patent No.: US 8,582,780 B2
(45) Date of Patent: Nov. 12, 2013

(54) CONFIGURABLE RECURSIVE DIGITAL FILTER FOR PROCESSING TELEVISION AUDIO SIGNALS

(75) Inventor: Matthew S. Barnhill, Duluth, GA (US)

(73) Assignee: THAT Corporation, Milford, MA (US)

( * ) Notice: Subject to any disclaimer, the term of this patent is extended or adjusted under 35 U.S.C. 154(b) by 0 days.

(21) Appl. No.: 12/896,468

(22) Filed: Oct. 1, 2010

(65) Prior Publication Data

US 2011/0026719 A1 Feb. 3, 2011

Related U.S. Application Data

(63) Continuation of application No. 11/204,723, filed on Aug. 16, 2005, now Pat. No. 7,822,210.

(60) Provisional application No. 60/602,169, filed on Aug. 17, 2004.

(51) Int. Cl.
*H04R 5/00* (2006.01)

(52) U.S. Cl.
USPC ..... 381/23; 700/94; 348/484

(58) Field of Classification Search
USPC ..... 381/1–4, 17–23, 104, 106; 348/481, 348/738, 484, 485, 483; 700/94; 704/504, 704/500; 278/404
See application file for complete search history.

(56) References Cited

U.S. PATENT DOCUMENTS

| | | | | |
|---|---|---|---|---|
| 4,747,140 | A | 5/1988 | Gibson | |
| 4,983,959 | A | 1/1991 | Breuninger | |
| 5,202,766 | A | 4/1993 | Mehrgardt et al. | |
| 5,377,272 | A | 12/1994 | Albean | |
| 6,037,993 | A | 3/2000 | Easley | |
| 6,118,879 | A * | 9/2000 | Hanna | 381/106 |
| 6,211,903 | B1 * | 4/2001 | Bullister | 348/14.16 |
| 6,259,482 | B1 | 7/2001 | Easley et al. | |
| 6,588,867 | B1 | 7/2003 | Darr | |
| 7,277,860 | B2 | 10/2007 | Srinivas et al. | |
| 7,532,728 | B2 | 5/2009 | Venkatesan et al. | |
| 2003/0054774 | A1 | 3/2003 | Plunkett et al. | |
| 2003/0161477 | A1 * | 8/2003 | Wu et al. | 381/2 |
| 2005/0036627 | A1 * | 2/2005 | Venkatesan et al. | 381/2 |

FOREIGN PATENT DOCUMENTS

| | | | |
|---|---|---|---|
| EP | 1296455 | * | 3/2003 |
| JP | S63-094715 | | 4/1988 |
| JP | H03-502027 | | 5/1991 |
| JP | H06-209234 | | 7/1994 |

(Continued)

OTHER PUBLICATIONS

The International Search Report and Written Opinion from corresponding PCT Application No. PCT/US2005/29108.
Bao Bengang, "IIR and FIR Designs for Digital Filters," The Journal of Lingling University, 24:67-68 (2003) (English Translation enclosed).

(Continued)

*Primary Examiner* — Lun-See Lao
(74) *Attorney, Agent, or Firm* — McDermott Will & Emery LLP

(57) ABSTRACT

A television audio signal encoder includes a device that sums a left channel audio signal and a right channel audio signal to produce a sum signal. The device also subtracts one of the left and right audio signals from the other to produce a difference signal. The encoder also includes a configurable infinite impulse response digital filter that selectively uses one or more sets of filter coefficients to filter the difference signal. The set of filter coefficients is applied to the difference signal by a single multiplier in a recursive manner to prepare the difference signal for transmission.

26 Claims, 8 Drawing Sheets

(56) References Cited

FOREIGN PATENT DOCUMENTS

| | | |
|---|---|---|
| JP | H06-216805 | 8/1994 |
| JP | H11-004461 | 1/1999 |
| JP | 2000-138547 | 5/2000 |
| TW | 401713 | 8/2000 |
| TW | 200304749 | 10/2003 |
| WO | WO2004/047074 | 6/2004 |
| WO | WO2005/094529 | 10/2005 |

OTHER PUBLICATIONS

Darr, "Designing Low-Cost Digital BTSC Stereo Encoders for Consumer Video Source Equipment," Consumer Electronics, 2000. ICCE. 2000 Digest of Technical Papers., International Conference, pp. 340,341 (2000).

Office Action dated May 9, 2013 from Corresponding Taiwan Patent Application No. 94128026.

* cited by examiner

CONFIGURABLE RECURSIVE DIGITAL FILTER FOR PROCESSING TELEVISION AUDIO SIGNALS

RELATED APPLICATION AND TECHNICAL FIELD

This application is a divisional application of U.S. application Ser. No. 11/204,723 filed Aug. 16, 2006, and entitled "Configurable Recursive Digital Filter for Processing Television Audio Signals," which claims priority to U.S. Provisional Patent Application Ser. No. 60/602,169, filed Aug. 17, 2004, and entitled "Digital Architecture for a BTSC Encoder/Decoder with SAP"; the entire contents of both of which applications are incorporated herein by reference.

This disclosure relates to processing television audio signals and, more particularly, to a configurable architecture for use with encoding and decoding television audio signals.

BACKGROUND

In 1984, the United States, under the auspices of the Federal Communications Commission, adopted a standard for the transmission and reception of stereo audio for television. This standard is codified in the FCC's Bulletin OET-60, and is often called the BTSC system after the Broadcast Television Systems Committee that proposed it, or the MTS (Multichannel Television Sound) system.

Prior to the BTSC system, broadcast television audio was monophonic, consisting of a single "channel" or signal of audio content. Stereo audio typically requires the transmission of two independent audio channels, and receivers capable of detecting and recovering both channels. In order to meet the FCC's requirement that the new transmission standard be 'compatible' with existing monophonic television sets (i.e., that mono receivers be capable of reproducing an appropriate audio signal from the new type of stereo broadcast), the Broadcast Television Systems Committee adopted an approach similar to FM radio systems: stereo Left and Right audio signals are combined to form two new signals, a Sum signal and a Difference signal.

Monophonic television receivers detect and demodulate only the Sum signal, consisting of the addition of the Left and Right stereo signals. Stereo-capable receivers receive both the Sum and the Difference signals, recombining the signals to extract the original stereo Left and Right signals.

For transmission, the Sum signal directly modulates the aural FM carrier just as would a monophonic audio signal. The Difference channel, however, is first modulated onto an AM subcarrier located 31.768 kHz above the aural carrier's center frequency. The nature of FM modulation is such that background noise increases by 3 decibel (dB) per octave, and as a result, because the new subcarrier is located further from the aural carrier's center frequency than the Sum or mono signal, additional noise is introduced into the Difference channel, and hence into the recovered stereo signal. In many circumstances, in fact, this rising noise characteristic renders the stereo signal too noisy to meet the requirements imposed by the FCC, and so the BTSC system mandates a noise reduction system in the Difference channel signal path.

This system, sometimes referred to as dbx noise reduction (after the company that developed the technique) is of the companding type, comprising an encoder and decoder. The encoder adaptively filters the Difference signal prior to transmission such that amplitude and frequency content, upon decoding, hide ("mask") noise picked up during the transmission process. The decoder completes the process by restoring the Difference signal to original form and thereby ensuring that noise is audibly masked by the signal content.

The dbx noise reduction system is also used to encode and decode Secondary Audio Programming (SAP) signals, which is defined in the BTSC standard as an additional information channel and is often used to e.g., carry programming in an alternative language, reading services for the blind, or other services.

Cost is, of course, of prime concern to television manufacturers. As a result of intense competition and consumer expectations, profit margins on consumer electronics products, especially television products, can be vanishingly small. Because the dbx decoder is located in the television receiver, manufacturers are sensitive to the cost of the decoder, and reducing the cost of the decoder is a necessary and worthwhile goal. While the encoder is not located in a television receiver and is not as sensitive from a profit standpoint, any development which will decrease manufacturing costs of the encoder also provides a benefit.

SUMMARY OF THE DISCLOSURE

In accordance with an aspect of the disclosure, a television audio signal encoder includes a device that sums a left channel audio signal and a right channel audio signal to produce a sum signal. The matrix also subtracts one of the left and right audio signals from the other to produce a difference signal. The encoder also includes a configurable infinite impulse response digital filter that selectively uses one or more sets of filter coefficients to filter the difference signal. The set of filter coefficients is applied to the difference signal by a single multiplier in a recursive manner to prepare the difference signal for transmission.

In one embodiment, the configurable infinite impulse response digital filter may include a feedback path to apply the set of filter coefficients to the difference signal in a recursive manner. This feedback path may include a shift register to delay digital signals associated with the difference signal. The configurable infinite impulse response digital filter may multiple a signal associated with the difference signal and provide an output of this multiplication. The configurable infinite impulse response digital filter may include a selector that selects a digital input signal or selects one of the filter coefficients. In some arrangements the selector may include a multiplexer. The infinite impulse response digital filter may be configured to provide various filtering functions such as a low pass filter. The configurable infinite impulse response digital filter may also include a single adder for applying the filter coefficients to the difference signal in a recursive manner. The television audio signal may comply to the Broadcast Television System Committee (BTSC) standard, the Near Instantaneously Companded Audio Muliplex (NICAM) standard, the A2/Zweiton standard, the EIA-J standard, or other similar audio standard. The configurable infinite impulse response digital filter may be implemented in an integrated circuit.

In accordance with another aspect of the disclosure, a television audio signal decoder includes a configurable infinite impulse response digital filter that selectively uses one or more sets of filter coefficients to filter a difference signal. The difference signal is produced by subtracting one of a left channel and a right channel audio signal from the other audio signal. The set of filter coefficients is applied to the difference signal by a single multiplier in a recursive manner to prepare the difference signal for separating the left channel and right channel audio signals. The decoder also includes a device that separates the left channel and right channel audio signals from the difference signal and a sum signal. The sum signal includes the sum the left channel audio signal and the right channel audio signal.

In one embodiment, the configurable infinite impulse response digital filter may include a feedback path to apply the set of filter coefficients to the difference signal in a recursive manner. This feedback path may include a shift register to delay digital signals associated with the difference signal. The configurable infinite impulse response digital filter may multiple a signal associated with the difference signal and provide an output of this multiplication. The configurable infinite impulse response digital filter may include a selector that selects a digital input signal or selects one of the filter coefficients. In some arrangements the selector may include a multiplexer. The infinite impulse response digital filter may be configured to provide various filtering functions such as a low pass filter. The configurable infinite impulse response digital filter may also include a single adder for applying the filter coefficients to the difference signal in a recursive manner. The television audio signal may comply to the Broadcast Television System Committee (BTSC) standard, the Near Instantaneously Companded Audio Muliplex (NICAM) standard, the A2/Zweiton standard, the EIA-J standard, or other similar audio standard. The configurable infinite impulse response digital filter may be implemented in an integrated circuit.

BRIEF DESCRIPTION OF THE DRAWINGS

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE EMBODIMENTS

Figure 1:
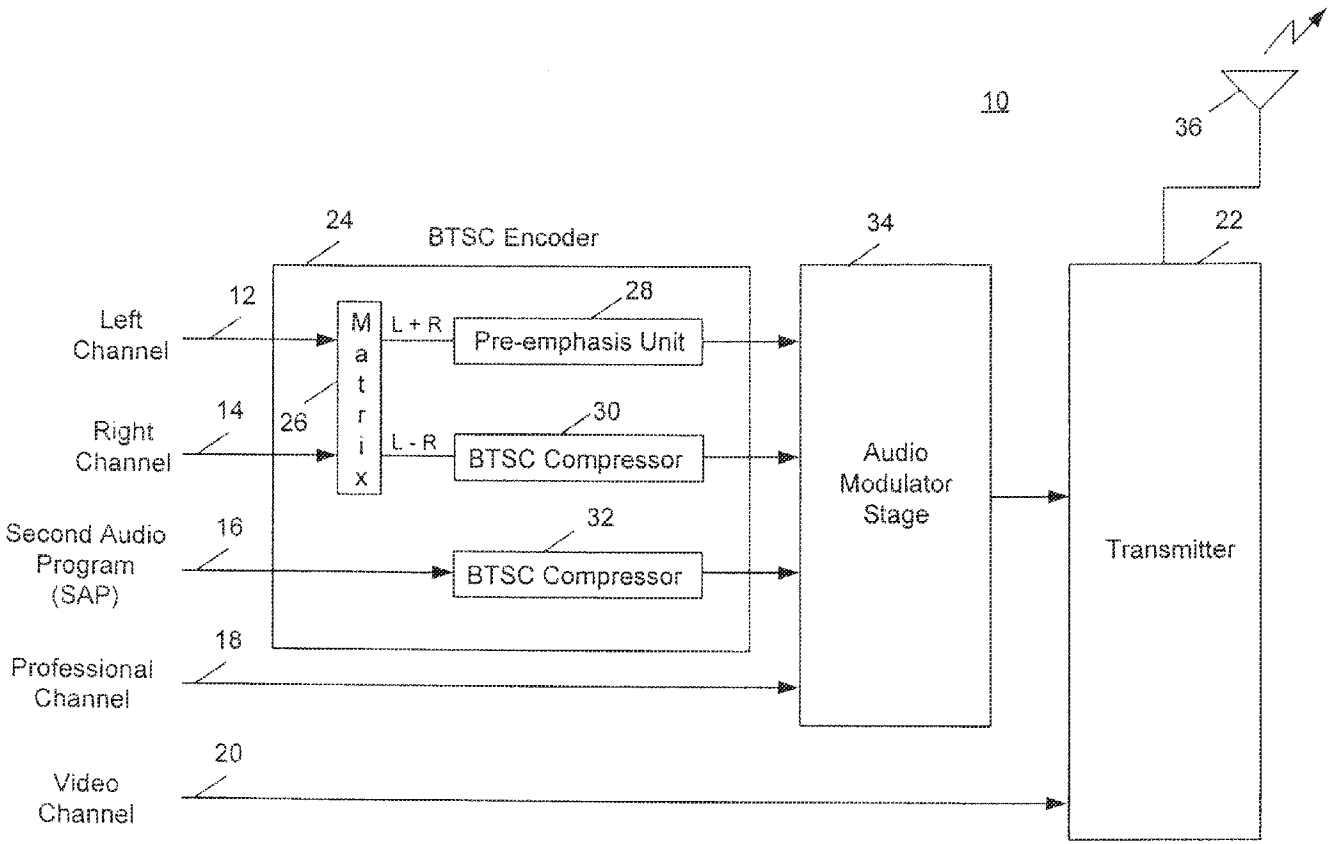
FIG. 1 is a block diagram representing a television signal transmission system that is configured to comply with the BTSC television audio signal standard.

Referring to FIG. 1, a functional block diagram of a BTSC compatible television signal transmitter 10 includes five lines (e.g., conductive wires, cables, etc.) that provide signals for transmission. In particular, left and right audio channels are provided on respective lines 12 and 14. An SAP signal is provided by line 16 in which the signal has content to provide additional channel information (e.g., alternative languages, etc.). A fourth line 18 provides a professional channel that is typically used by broadcast television and cable television companies. Video signals are provided by a line 20 to a transmitter 22. The left, right, and SAP channels are provided to a BTSC encoder 24 that prepares the audio signals for transmission. Specifically, the left and right audio channels are provided to a matrix 26 that calculates a sum signal (e.g. L+R) and a difference signal (e.g., L−R) from the audio signals. Typically operations of matrix 26 are performed by utilizing a digital signal processor (DSP) or similar hardware or software—based techniques known to one skilled in the art of television audio and video signal processing. Once produced, sum and difference signals (i.e., L+R and L−R) are encoded for transmission. In particular, the sum signal (i.e., L+R) is provided to a pre-emphasis unit 28 that alters the magnitude of select frequency components of the sum signal with respect to other frequency components. The alteration may be in a negative sense in which the magnitude of the select frequency components are suppressed, or the alteration may be in a positive sense in which the magnitude of the select frequency components are enhanced.

The difference signal (i.e., L+R) is provided to a BTSC compressor 30 that adaptively filters the signal prior to transmission such that when decoded, the signal amplitude and frequency content suppress noise imposed during transmission. Similar to the difference signal, the SAP signal is provided to a BTSC compressor 32. An audio modulator stage 34 receives the processed sum signal, difference signal, and SAP signal. Additionally, signals from the professional channel are provided to audio modulator stage 34. The four signals are modulated by audio modulator stage 34 and provided to transmitter 22. Along with the video signals provided by the video channel, the four audio signals are conditioned for transmission and provided to an antenna 36 (or an antenna system). Various signal transmitting techniques known to one skilled in the art of television systems and telecommunications may be implemented by transmitter 22 and antenna 36. For example, transmitter 22 may be incorporated into a cable television system, a broadcast television system, or other similar television system.

Figure 2:
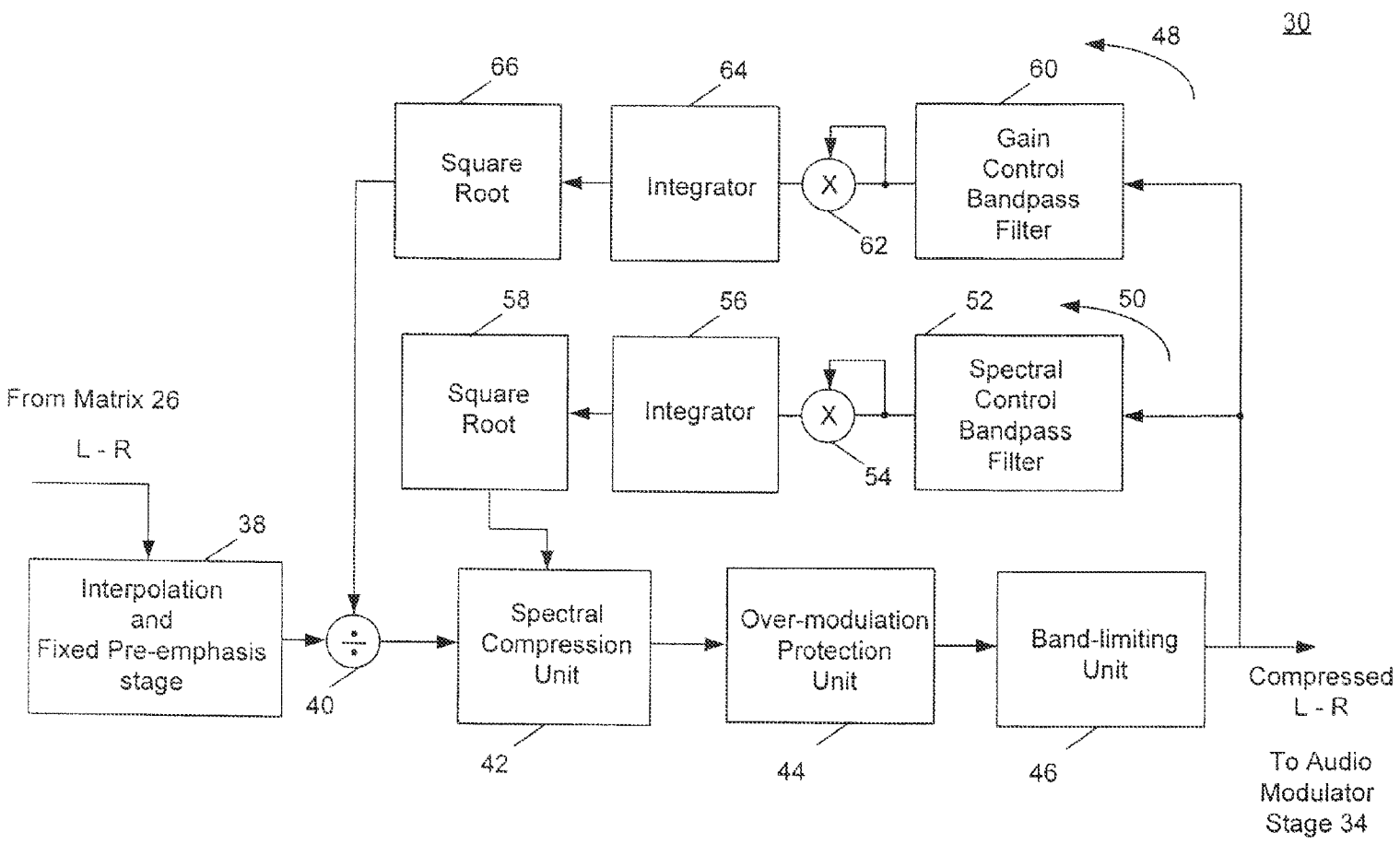
FIG. 2 is a block diagram representing a portion of a BTSC encoder included in the television signal transmission system shown in FIG. 1.

Referring to FIG. 2, a block diagram representing operations performed by a portion of BTSC compressor 30 is shown. In general, the difference channel (i.e., L−R) processing performed by BTSC compressor 30 is considerably more complex than the sum channel (i.e., L+R) processing by pre-emphasis unit 28. The additional processing provided by the difference channel processing BTSC compressor 30, in combination with complementary processing provided by a decoder (not shown) receiving a BTSC signal, maintains the signal-to-noise ratio of the difference channel at acceptable levels even in the presence of the higher noise floor associated with the transmission and reception of the difference channel. BTSC compressor 30 essentially generates the encoded difference signal by dynamically compressing, or reducing the dynamic range of the difference signal so that the encoded signal may be transmitted through a limited dynamic range transmission path, and so that a decoder receiving the encoded signal may recover substantially all the dynamic range in the original difference signal by expanding the compressed difference signal in a complementary fashion. In some arrangements, BTSC compressor 30 implements a particular form of an adaptive signal weighing system described in U.S. Pat. No. 4,539,526, incorporated by reference herein, and which is known to be advantageous for transmitting a signal having a relatively large dynamic range through a transmission path having a relatively narrow, frequency dependent, dynamic range.

The BTSC standard rigorously defines the desired operation of BTSC encoder 24 and BTSC compressors 30 and 32. Specifically, the BTSC standard provides transfer functions and/or guidelines for the operation of each component included e.g., in BTSC compressor 30 and the transfer functions are described in terms of mathematical representations of idealized analog filters. Upon receiving the difference signal (i.e., L−R) from matrix 26, the signal may be provided to an interpolation and fixed pre-emphasis stage 38. In some digital BTSC encoders, the interpolation is set for twice the sample rate and the interpolation may be accomplished by linear interpolation, parabolic interpolation, or a filter (e.g., a finite impulse response (FIR) filter, an infinite impulse response (IIR) filter, etc.) of n-th order. The interpolation and fixed pre-emphasis stage 38 also provides pre-emphasis. After interpolation and pre-emphasis, the difference signal is provided to a divider 40 that divides the difference signal by a quantity determined from the difference signal and described in detail below.

The output of divider 40 is provided to a spectral compression unit 42 that performs emphasis filtering of the difference signal. In general, spectral compression unit 42 "compresses", or reduces the dynamic range, of the difference signal by amplifying signals having relatively low amplitudes and attenuating signals having relatively large amplitudes. In some arrangements spectral compression unit 42 produces an internal control signal from the difference signal that controls the pre-emphasis/de-emphasis that is applied. Typically, spectral compression unit 42 dynamically compresses high frequency portions of the difference signal by an amount determined by the energy level in the high frequency portions of the encoded difference signal. Spectral compression unit 42 thus provides additional signal compression toward the higher frequency portions of the difference signal. This is done because the difference signal tends to be noisier in the higher frequency portion of the spectrum. When the encoded difference signal is decoded with a spectral expander in a decoder, respectively in a complementary manner to the spectral compression unit of the encoder, the signal-to-noise ratio of the L−R signal is substantially preserved.

Once processed by spectral compression unit 42, the difference signal is provided to an over-modulation protection unit 44 and band-limiting unit 46. Similar to the other components, the BTSC standard provides suggested guidelines for the operation of over-modulation protection unit 44 and band-limiting unit 46. Generally, band-limiting unit 46 and a portion of over-modulation protection unit 44 may be implemented as low pass filters. Over-modulation protection unit 44 also performs as a threshold device that limits the amplitude of the encoded difference signal to full modulation, where full modulation is the maximum permissible deviation level for modulating an audio subcarrier in a television signal.

Two feedback paths 48 and 50 are included in BTSC compressor 30. Feedback path 50 includes a spectral control bandpass filter 52 that typically has a relatively narrow pass band that is weighted towards higher audio frequencies to provide a control signal for spectral compression unit 42. To condition the control signal produced by spectral control bandpass filter 52, feedback path 50 also includes a multiplier 54 (configured to square the signal provided by spectral control bandpass filter 52), an integrator 56, and a square root device that provides the control signal to spectral compression unit 42. Feedback path 48 also includes a bandpass filter (i.e., gain control bandpass filter 60) that filters the output signal from band-limiting unit 46 to set the gain applied to the output signal of interpolation and fixed pre-emphasis stage 38 via divider 40. Similar to feedback path 50, feedback path 48 also includes a multiplier 62, an integrator 64, and a square root device 66 to condition the signal that is provided to divider 40.

Figure 3:
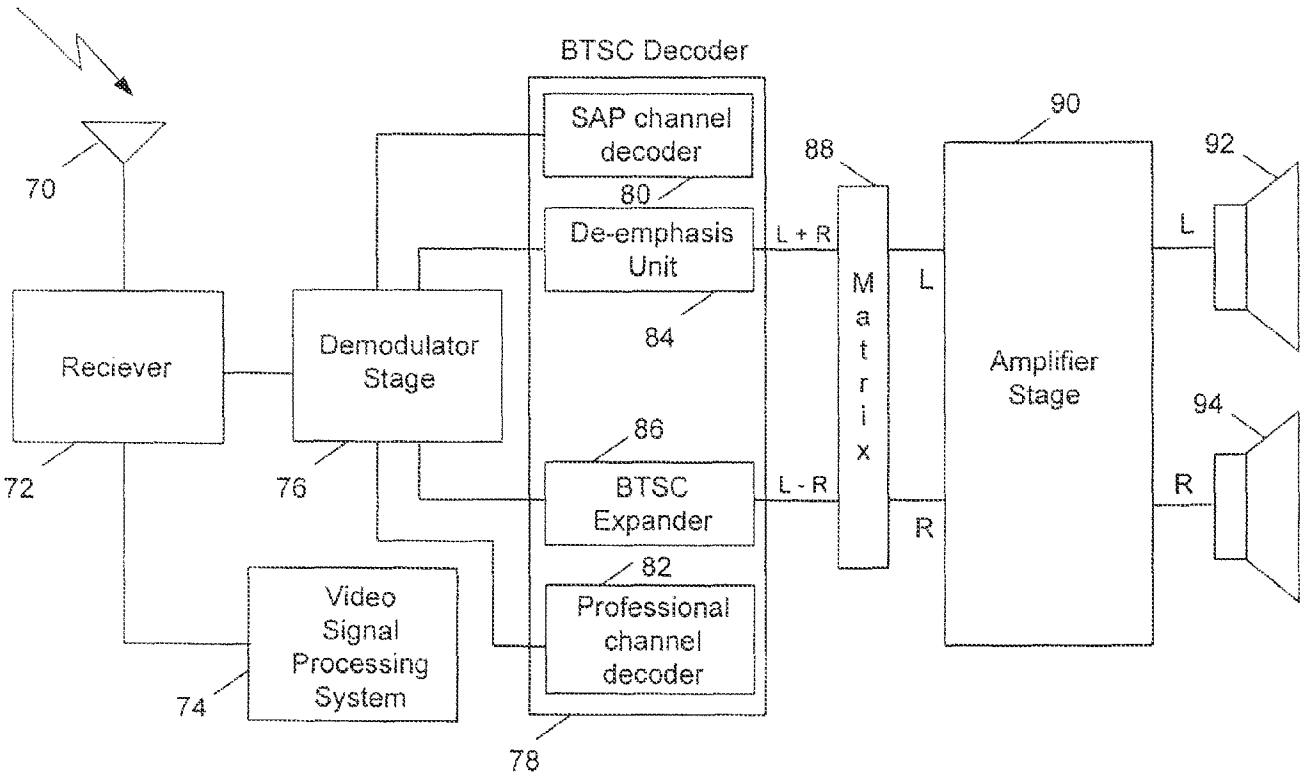
FIG. 3 is a block diagram representing a television receiver system that is configured to receive and decode BTSC television audio signals sent by the television signal transmission system shown in FIG. 1.

Referring to FIG. 3, a block diagram is shown that represents a television receiver system 68 that includes an antenna 70 (or a system of antennas) to receive BTSC compatible broadcast signals from television transmission system 10 (shown in FIG. 1). The signals received by antenna 70 are provided to a receiver 72 that is capable of detecting and isolating the television transmission signals. However, in some arrangements receiver 72 may receive the BTSC compatible signals from another television signal transmission technique known to one skilled in the art of television signal broadcasting. For example, the television signals may be provided to receiver 72 over a cable television system or a satellite television network.

Upon receiving the television signals, receiver 72 conditions (e.g., amplifies, filters, frequency scales, etc.) the signals and separates the video signals and the audio signals out of the transmission signals. The video content is provided to a video processing system 74 that prepares the video content contained in the video signals for presentation on a screen (e.g., a cathode ray tube, etc.) associated with the television receiver system 68. Signals containing the separate audio content are provided to a demodulator stage 76 that e.g., removes the modulation applied to the audio signals at television transmission system 10. The demodulated audio signals (e.g., the SAP channel, the professional channel, the sum signal, the difference signal) are provided to a BTSC decoder 78 that appropriately decodes each signal. The SAP channel is provided a SAP channel decoder 80 and the professional channel is provided to a professional channel decoder 82. After separating the SAP channel and the professional channel, a demodulated sum signal (i.e. L+R signal) is provided to a de-emphasis unit 84 that processes the sum signal in a substantially complementary fashion in comparison to pre-emphasis unit 28 (shown in FIG. 1). Upon de-emphasizing the spectral content of the sum signal, the signal is provided to a matrix 88 for separating the left and right channel audio signals.

The difference signal (i.e., L−R) is also demodulated by demodulation stage 76 and is provided to a BTSC expander 86 included in BTSC decoder 78. BTSC expander 86 complies with the BTSC standard, and as described in detail below, conditions the difference signal. Matrix 88 receives the difference signal from BTSC expander 86 and with the sum signal, separates the right and left audio channels into independent signals (identified in FIG. 3 as "L" and "R"). By separating the signals, the individual right and left channel audio signals may be conditioned and provided to separate speakers. In this example, both the left and right audio channels are provided to an amplifier stage 90 that applies the same (or different) gains to each channel prior to providing the respective signals to a speaker 92 for broadcasting the left channel audio content and another speaker 94 for broadcasting the right channel audio content.

Figure 4:
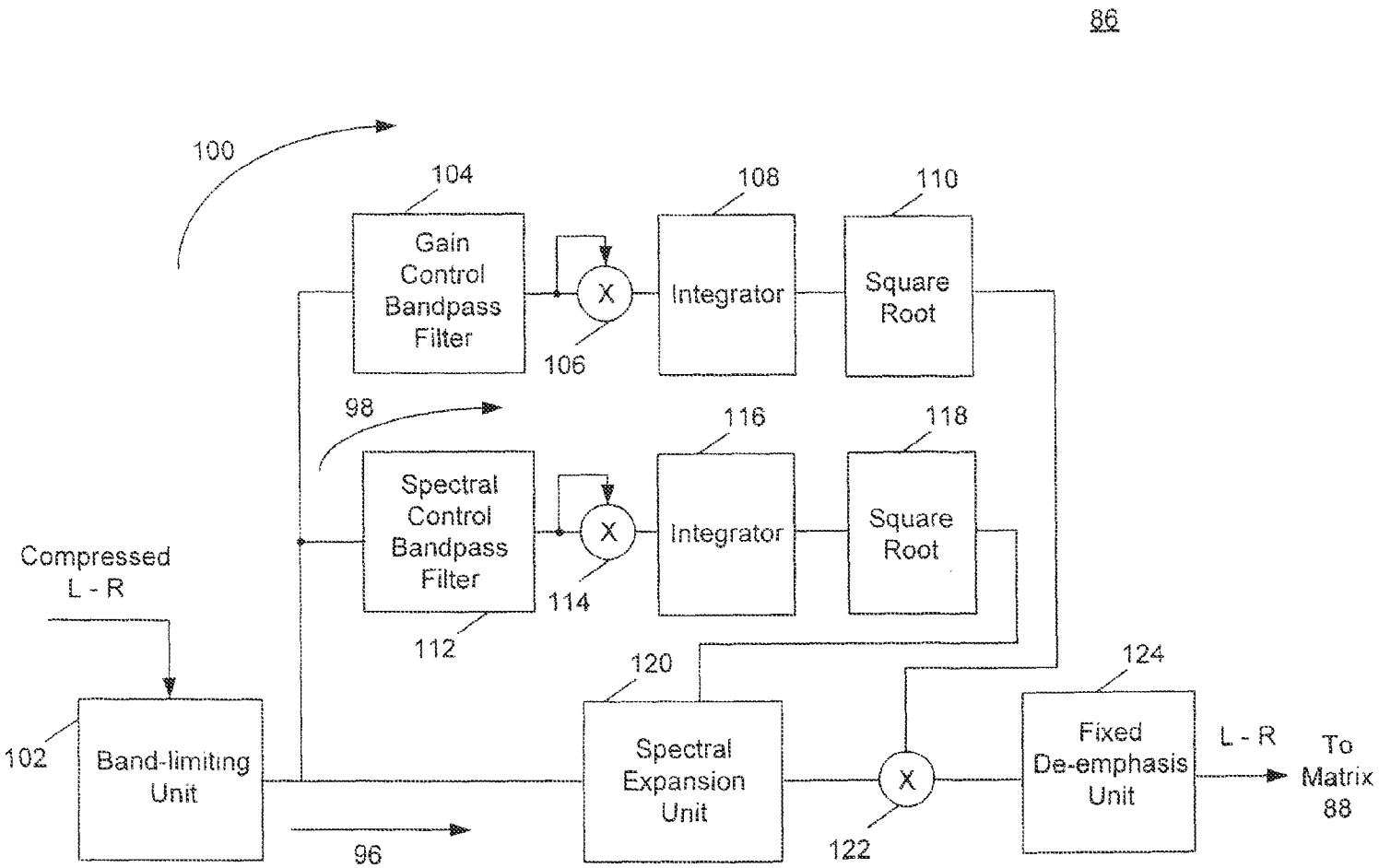
FIG. 4 is a block diagram representing a portion of a BTSC decoder included in the television receiver system shown in FIG. 3.

Referring to FIG. 4, a block diagram identifies some of the operations performed by BTSC expander 86 to condition the difference signal. In general, BTSC expander 86 performs operations that are complementary to the operations performed by BTSC compressor 32 (shown in FIG. 2). In particular, the compressed difference signal is provided to a signal path 96 for un-compressing the signal, and to two paths 98 and 100 that produce a respective control and gain signal to assist the processing of the difference signal. To initiate the processing, the compressed difference signal is provided to a band-limiting unit 102 that filters the compressed difference signal. The band-limiting unit 102 provides a signal to path 98 to produce a control signal and to path 100 to produce a gain signal. Path 100 includes a gain control bandpass filter 104, a multiplier 106 (that squares the output of the gain control bandpass filter), an integrator 108, and a square root device 110. Signal path 98 also receives the signal from band-limiting unit 102 and processes the signal with a spectral control bandpass filter 112, a squaring device 114, an integrator 116, and a square root device 118. Path 98 then provides a control signal to a spectral expansion unit 120 that performs an operation that is complementary to the operation performed by spectral compression unit 42 shown in FIG. 2. The gain signal produced by path 100 is provided to a multiplier 122 that receives an output signal from spectral expansion unit 120. Multiplier 122 provides the spectrally expanded difference signal to a fixed de-emphasis unit 124 that filters the signal in a complementary manner in comparison to filtering performed by BTSC compressor 30. In general, the term "de-emphasis" means the alteration of the select frequency components of the decoded signal in either a negative or positive sense in a complementary manner in which the original signal is encoded.

Both BTSC encoder 24 and BTSC decoder 78 include multiple filters that adjust the amplitude of audio signals as a function of frequency. In some prior art television transmission systems and reception systems, each of the filters are implemented with discrete analog components. However, with advancements in digital signal processing, some BTSC encoders and BTSC decoders may be implemented in the digital domain with one or more integrated circuits (ICs). Furthermore, multiple digital BTSC encoders and/or decoders may implemented on a single IC. For example, encoders and decoders may be incorporated into a single IC as a portion of a very large scale integration (VLSI) system.

A significant portion of the cost of an IC is directly proportional to the physical size of the chip, particularly the size of its 'die', or the active, non-packaging part of the chip. In some arrangements filtering operations performed in digital BTSC encoders and decoders may be executed using general purpose digital signal processors that are designed to execute a range of DSP functions and operations. These DSP engines tend to have relatively large die areas, and are thereby costly to use for implementing BTSC encoders and decoders. Additionally the DSP may be dedicated to executing other functions and operations. By sharing this resource, the processing performed by the DSP may overload and interfere with the processing of the BTSC encoder and decoder functions and operations.

In some arrangements, BTSC encoders and decoders may incorporate groups of basic components to reduce cost. For example, groups of multipliers, adders, and multiplexers may be incorporated to produce the BTSC encoder and decoder functions. However, while the groups of nearly identical components may be easily fabricated, the components represent significant die area and add to the total cost of the IC. Thus, a need exists to reduce the number of duplicated circuits components used to implement a digital BTSC encoder and/or decoder.

Figure 5:
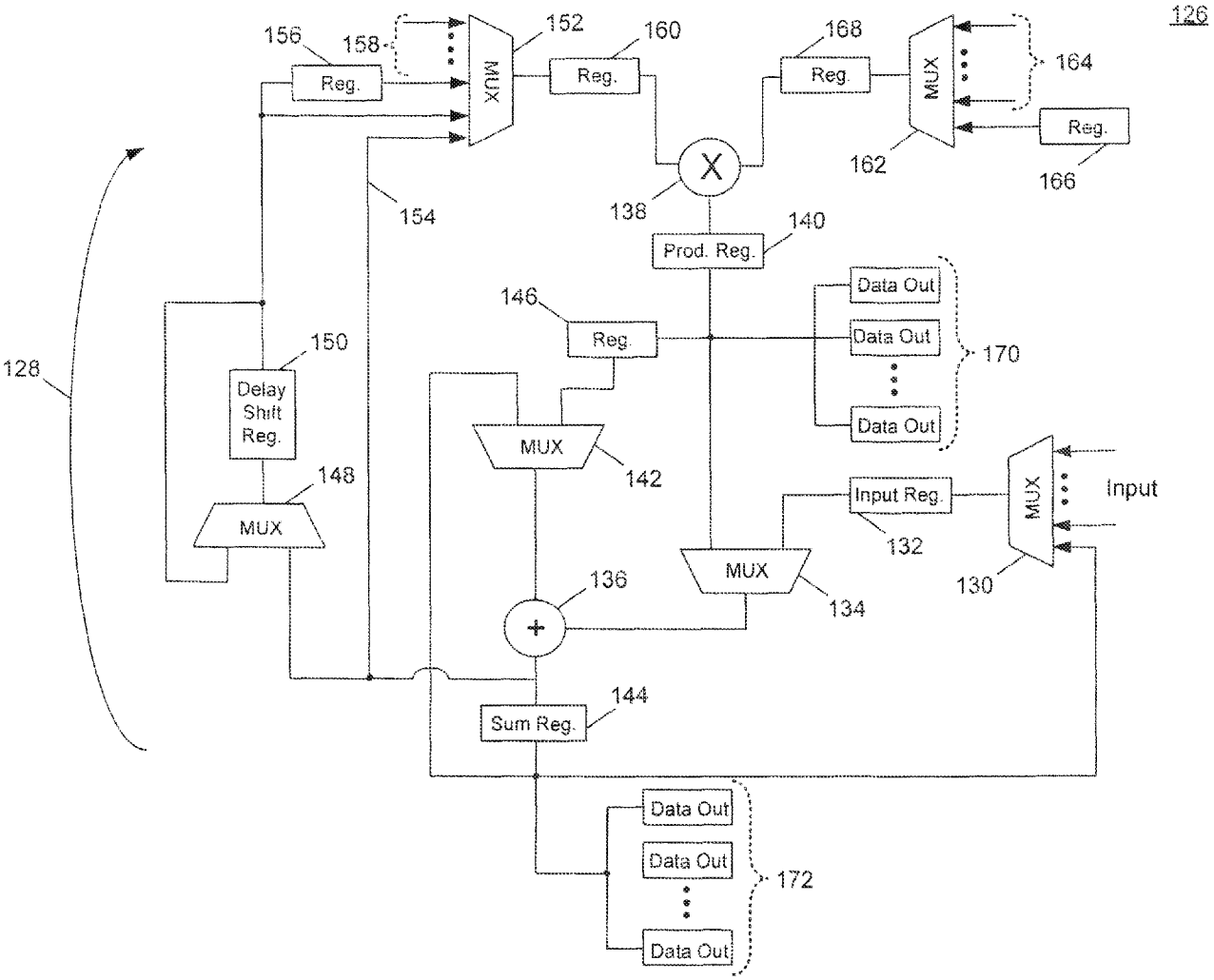
FIG. 5 is a diagrammatic view of a configurable infinite impulse response filter for performing operations of the encoder and decoder shown in FIG. 2 and FIG. 4.

Referring to FIG. 5, a block diagram of a configurable infinite impulse response (IIR) titter 126 is shown that is capable of performing multiple types of operations for a digital BTSC encoder and/or decoder. In particular, configurable HR filter 126 includes a digital architecture that is capable of performing various filtering, multiplication, and delay operations. Regarding filtering operations, by providing selectable filtering coefficients, configurable IIR filter 126 may be configured for various types of filters and different filtering operations. For example, filtering coefficients may be selected to provide a low pass filter, a high pass filter, a band pass filter, or other type of filters known to one skilled in the art of filter design. Thus, one or a relatively small number of implementations of configurable IIR filter 126 may be used to provide most or all of the filtering needs of a BTSC encoder or a BTSC decoder. By reducing the number of decoder and encoder filters, the implementation area of an IC chip is reduced along with the production cost of the BTSC encoders and decoders. Other embodiments of configurable IIR filter 126 are described in "Configurable Filter for Processing Television Audio Signals," U.S. patent application Ser. No. 11/089,385, filed Mar. 24, 2005, which is incorporated by reference herein.

Along with using components for selecting filter coefficients, by using a recursive digital architecture, the number of components may be further reduced. In this exemplary design, configurable IIR filter 126 includes a feedback path 128 that passes digital signals from the output portion of the architecture to components for further processing. By passing processed digital signals through feedback path 128, various types of recursive processing may be provided by configurable IIR filter 126. For example, higher order filters (e.g., second-order or higher) may be realized by passing signals through feedback path 128.

In this implementation, various digital input signals are provided on inputs of a multiplexer 130 that functions as a selector. For example, signals may be input from various portions of a compressor such as BTSC compressor 30 (shown in FIG. 2). Interpolation and fixed pre-emphasis stage 38, gain control bandpass filter 60, and spectral control bandpass filter 52 may provide digital signals to multiplexer 130. Dependent upon appropriate scheduling, multiplexer 130 selects one input for processing an appropriate input signal. The selected signal is provided to an input register 132 and then to a multiplexer 134 at an appropriate time. Multiplexer 134 provides a single adder 136 with data from either input register 132 (e.g., new input data) or previously computed product data from a single multiplier 138 (via a product register 140). Adder 136 also receives input data from a multiplexer 142 that is either previously accumulated data from a sum register 144 (that is preferably connected the output of adder 136) or product data from multiplier 138 (preferably provided through product register 140 and a register 146).

To provide the digital input signals for processing and recursive processing for previously processed signals, feedback path 128 provides the output of adder 136 to multiplier 138. In particular, the output of adder 136 is provided a multiplexer 148 that provides an output signal to a shift register 150. Either the output signal of adder 136 or a delayed version of a signal (output from shift register 150) is provided to the input of shift register 150. By including shift register 150 in feedback path 128, a time delay may be applied to a digital signal prior to processing by multiplier 138. For filtering applications, time delays introduced by shift register 150 may be used for implementing higher order filters (e.g., a second-order filter).

The output of shift register 150 is provided (as mentioned above) to the input of multiplexer 148. Feedback path 128 provides data to multiplier 138 through a multiplexer 152. In particular, digital signals may be feedback directly over conductor 154 from the output of adder 136. Signals may also be feedback as provided by the output of shift register 150 or a delayed version of the output of shift register 150 (via a register 156). External multiplicands may also be provided to the inputs of multiplexer 158. As shown in the figure, external data may be provided to one or more input lines 158 of multiplexer 152. A register 160 is provided an output signal from multiplexer 152 in preparation for multiplication by multiplier 138.

Data such as filter coefficients (with fixed or variable values) may be provided to configurable IIR filter 126 by a multiplexer 162. In particular, data representing filter coefficients may be provided to multiplexer 162 from input lines 164. External multiplicands may also be provided by input lines 164. Along with being supplied externally, coefficient or multiplicands may be provided to multiplexer 162 by a register 166. Similar to multiplexer 152, multiplexer 162 provides data to a register 168 in preparation for providing the data to multiplier 138.

Since feedback path 128 is included in configurable HR filter 126, a single multiplier (i.e., multiplier 138) may be incorporated to provide the multiplication function within for implementing the filter. By implementing this single multiplier scheme, integrated circuit real estate may be conserved and used to provide other functionality. For example, a series of output registers may be implemented to directly provide the output of product register 140 to external devices and components. Additionally, due to feedback path 128, a single adder (i.e., adder 136) provides the addition functionality to implement various types of HR filters. Again, by using a single component, in this case adder 136, additional chip real estate is conserved for other components. For example, a series of output registers 172 may be implemented for directing the output of adder 136 (via sum register 144) to external components or modules that are located on the same integrated circuit or on an external device.

In addition to providing a multiplication function (with outputs provided by output registers 170) and filtering functions (with outputs provided by output registers 172), configurable IIR filter 126 may also provide a time delay function. For example, the output of shift register 150 and/or the output of register 156 may be used to provide time-delayed version of one or more digital signals provided to the registers.

To allow configurable IIR filter 126 to perform multiple types of filtering operations, the multiplexer 130 controls which input provides an input signal. Referring briefly to FIG. 2, some of the inputs to multiplexer 130 may be connected to provide input signals for each of the filtering operations performed within BTSC compressor 30. For example, the input to gain control bandpass filter 60 may be connected an input of multiplexer 130. Similarly, the input to spectral control bandpass filter 52 may be connected to another input of multiplexer 130. Then, multiplexer 130 may control which particular filtering operation is performed by configurable IIR filter 126. For example, during one time period, the appropriate input may be selected and configurable IIR filter 126 may be configured to provide the filtering function of gain control bandpass filter 60. Then, at another time period, multiplexer 130 may be used to select another input to perform a different filtering operation. Along with selecting the other input, configurable IIR filter 126 may be correspondingly configured to provide a different type of filtering function, such as the filtering provided by spectral control bandpass filter 52.

In order to perform multiple filtering operations e.g., for a BTSC compressor or a BTSC expander, configurable HR filter 126 operates at a clock speed substantially faster than the other portions of the digital compressor or expander. By operating at a faster clock speed, configurable IIR filter 126 may perform one type of filtering without causing other operations of the digital compressor or expander to be delayed. For example, by operating configurable IIR filter 126 at a substantially fast clock speed, the architecture may first be configured to perform filtering for gain control bandpass filter 60 without substantially delaying the execution of the next filter configuration (e.g., filter operations for spectral control bandpass filter 52).

Figure 6:
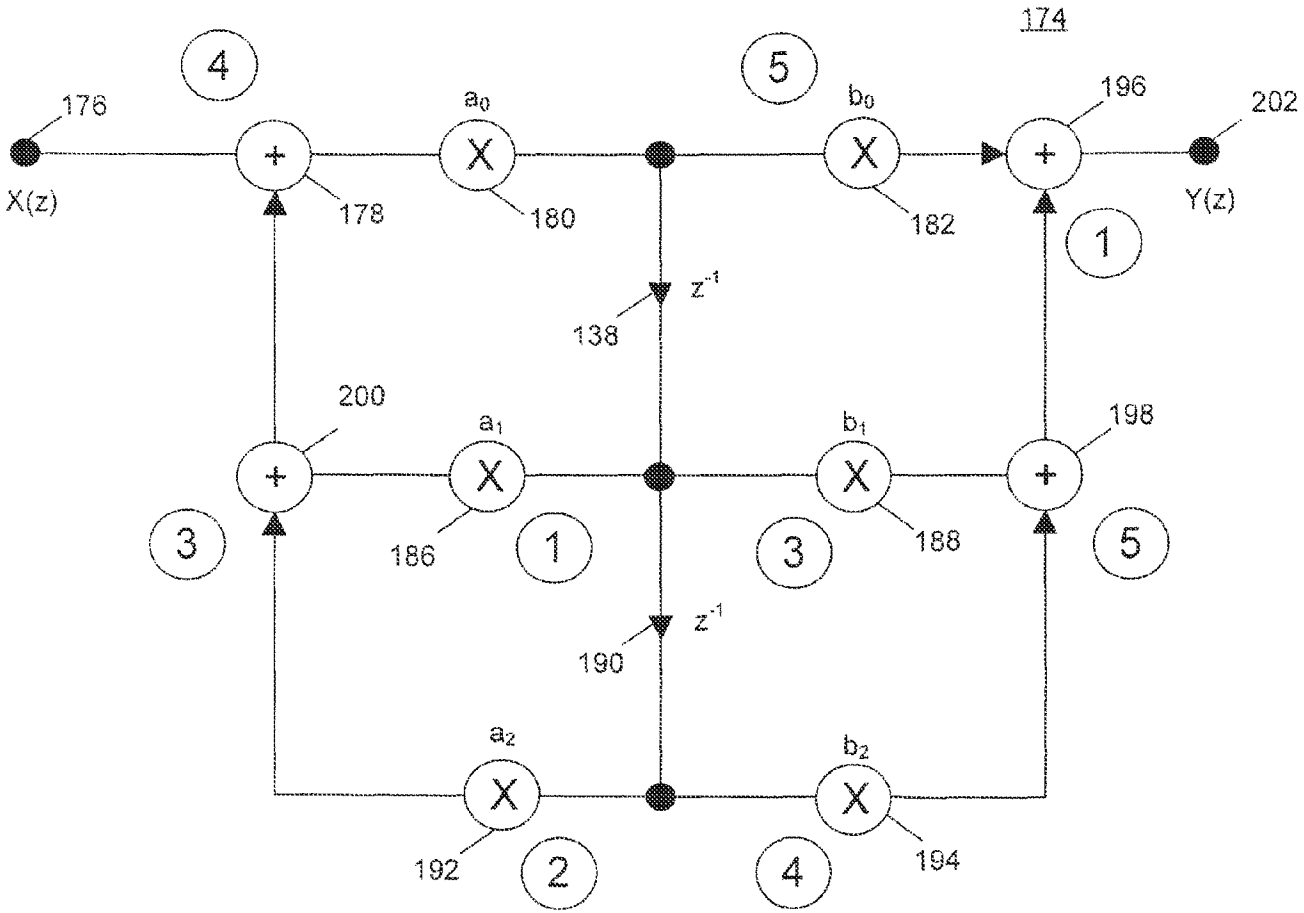
FIG. 6 is a graphical representation of a transfer function of a second-order infinite impulse response filter that may be implemented by the infinite impulse response filter shown in FIG. 5.

In one arrangement, configurable IIR filter 126 may be implemented as a second-order IIR filter. Referring to FIG. 6, a z-domain signal flow diagram 174 is presented for a typical second-order IIR filter. An input node 176 receives an input signal identified as X(z). The input signal is provided to an adder 178 that adds the signal to a processed signal that is described below. The output of adder 178 is provided to a gain stage 180 that applies a filter coefficient $a_0$ to the input signal. In some applications the filter coefficient $a_0$ has a unity value. Similarly, a filter coefficient $b_0$ is applied to the input signal at gain stage 182. At a delay stage 184, a time delay (i.e., represented in the z-domain as $z^{-1}$) is applied as the input signal enters the first-order portion of the filter and filter coefficients $a_1$ and $b_1$ are applied at respective gain stages 186 and 188. A second delay (i.e., $z^{-1}$) is applied at delay stage 190 for producing the second-order portion of filter 174 and filter coefficients $a_2$ and $b_2$ are applied at respective gain stages 192 and 194. Respective adders 196, 198, and 200 add signals from the gain stages and the filtered signal is provided to an output node 202 such that output signal Y(z) may be determined from the transfer function H(z) of the second-order filter 174, as described in the following Equation (1):

$$H(z) = \frac{b_0 + b_1 z^{-1} + b_2 z^{-2}}{a_0 + a_1 z^{-1} + a_2 z^{-2}}$$

Each of the coefficients (i.e., $b_0$, $a_0$, $b_1$, $a_1$, $b_2$, and $a_2$) included in the transfer function may be assigned particular values to produce a desired type of filter. For example, particular values may be assigned to the coefficients to produce a low-pass filter, a high-pass filter, or a band-pass filter, etc. Thus, by providing the appropriate values for each coefficient, the type and characteristics (e.g., pass band, roll-off, etc) of the second-order filter may be configured and reconfigured into another type of filter (dependent upon the application) with a different set of coefficients. While this example describes a second-order filter, in other arrangements an $n^{th}$-order filter may be implemented. For example, higher order (e.g. third-order, fourth-order, etc.) filters or lower order (e.g., first-order filters) may be implemented. Furthermore, for some applications, the recursive digital architecture of configurable HR filter 126 may be cascaded to produce $n^{th}$-order filters.

Referring back to FIG. 5, along with using multiplexer 130 to select a particular input for configurable HR filter 126, the coefficients used by the filter are selected to implement different types of filters and to provide particular filter characteristics. For example, coefficients may be selected to implement a low-pass filter, a high-pass filter, a band-pass filter, or other similar type of filter used to encode or decode BTSC audio signals. Due to the recursive processing provided by feedback path 128, different coefficients or sets of coefficients may be selected by multiplexer 152 and/or multiplexer 162. By selecting different coefficients for different recursive iterations, various filters may be implemented. For example, multiplexer 162 may be controlled to select a filter coefficient (e.g., $a_0$, $b_0$, $a_1$, $b_1$, etc.) associated with a second-order filter. Then, for the next iteration, multiplexer 162 may select another filter coefficient. By providing these selectable coefficients values, configurable IIR filter 126 may be configured to provide filters for both encoding and decoding operations. Upon completing the filtering for one application (e.g., gain control bandpass filter 60) for in a recursive manner, multiplexer 130 may then be placed in a position to provide input signals for another application (e.g., spectral control bandpass filter 52). By selecting this input, new filter coefficients may be selected by multiplexer 162 and/or multiplexer 152 to provide the particular filter type and filter characteristics needed to perform the filtering for this next application.

In this example illustrated in FIG. 6, configurable IIR filter 126 is configured for a second-order filter, however, some encoding and/or decoding filtering applications may call for a higher order filter. To provide higher order filters, additional recursive iterations may be performed through feedback path 128. By using the feedback path, signals may pass through the IIR filter multiple times using the same (or different) filter coefficients. Thus, filtering operations may be performed with a single multiplier (i.e., multiplier 138) and a single adder (i.e., adder 136) for various types of filters and various order filter implementations. To illustrate the iterations that are performed by configurable IIR filter 126, numerical indicators (i.e., 1, 2, 3, 4, 5) are shown to represent the individual clock cycles in which each function is executed. In this illustration, these functions execute in a sequence of: 1, 2, 3, 4, 5. Thus, five clock cycles are needed to compute an output for the second order filter. Additionally, this sequence of executed functions may be repeated in a periodic manner (e.g., 1, 2, 3, 4, 5, 1, 2, 3, 4, 5. etc.).

Various techniques and components known to one skilled in the art of electronics and filter design may be used to implement the multiplexers (e.g., multiplexer 130, 152, 162, etc.). For example, multiplexer 130 may be implemented by one or more multiplexers to select among the inputs. Besides multiplexers, or other types digital selection devices may be implemented to select appropriate filter coefficients. Various coefficient values may be used to configure IIR filter such as HR filter 174. For example, coefficients described in U.S. Pat. No. 5,796,842 to Hanna, which is herein incorporated by reference, may be used by configurable IIR filter 126. In some arrangements, the filter coefficients are stored in a memory (not shown) associated with the BTSC encoder or decoder and are retrieved by the appropriate multiplexers at appropriate times. For example, the coefficients may be stored in a memory chip (e.g., random access memory (RAM), read-only memory (ROM), etc.) or another type of storage device (e.g., a hard-drive, CD-ROM, etc.) associated with the BTSC encoder or decoder. The coefficients may also be stored in various software structures such as a look-up table, or other similar structure.

Configurable IIR filter 126 also includes a single adder 136 along with the single multiplier 138. Various techniques and/or components known to one skilled in the art of electronic circuit design and digital design may be used to implement adder 136 and the multiplier 138 included in configurable IIR filter 126. For example, logic gates such as one or more "AND" gates may be implemented as each of the multipliers. To introduce time delays, various techniques and/or components known to one skilled in the art of electronic circuit design and digital design may be implemented to produce shift register 150 (shown in FIG. 5) and provide delays by storing and holding the digitized input signal values for an appropriate number of clock cycles.

In this example, configurable HR filter 126 is implemented with hardware components, however, in some arrangements one or more operational portions of the architecture may be implemented in software. One exemplary listing of code that performs the operations of configurable IIR filter 126 is presented in appendix A of the parent application, U.S. patent application Ser. No. 11/204,723, which is incorporated herein by reference. The exemplary code is provided in Verilog, which, in general, is a hardware description language that is used by electronic designers to describe and design chips and systems prior to fabrication. This code may be stored on and retrieved from a storage device (e.g., RAM, ROM, hard-drive, CD-ROM, etc.) and executed on one or more general purpose processors and/or specialized processors such as a dedicated DSP.

Figure 7:
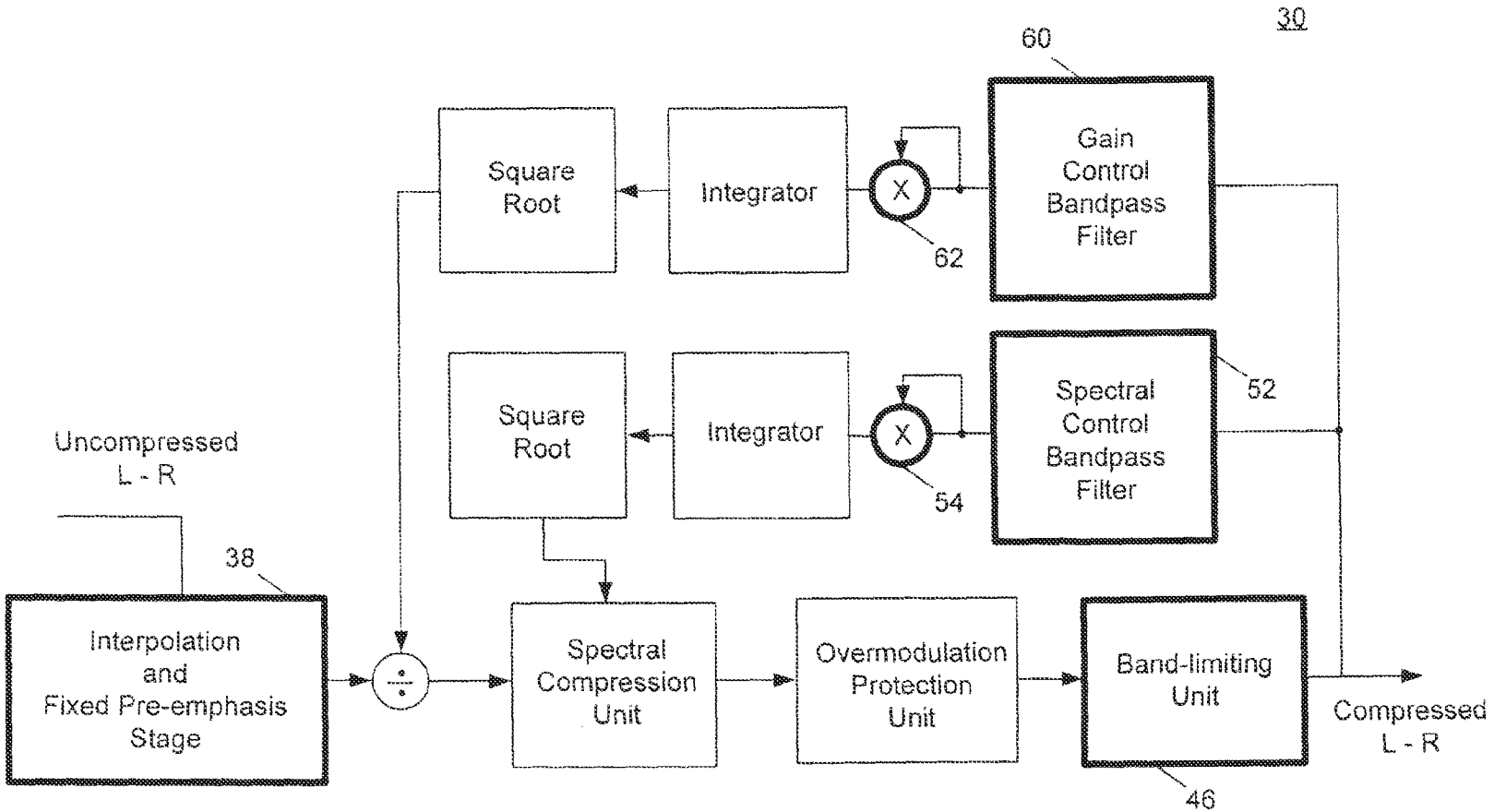
FIG. 7 is a block diagram of a portion of a BTSC encoder that highlights operations that may be performed by the configurable infinite impulse response filter shown in FIG. 5.

Referring to FIG. 7, a block diagram of BTSC compressor 30 is provided in which portions of the diagram are highlighted to illustrate functions that may be performed by a single (or multiple) implementations of configurable IIR filter 126. In particular, filtering performed by interpolation and fixed pre-emphasis stage 38 may be performed by configurable IIR filter 126. For example, an input of multiplexer 130 may be connected to the appropriate filter input within interpolation and fixed pre-emphasis stage 38. Correspondingly, when this input of multiplexer 130 is selected, filter coefficients may be retrieved from memory and used to produce to an appropriate filter type and filter characteristics. Similarly, gain control bandpass filter 60 may be assigned to another input of multiplexer 130 in digital configurable IIR filter 126 and spectral control bandpass filter 52 may be assigned to still another input of multiplexer 130. Band-limiting unit 46 may be assigned to another input of multiplexer 130. For each of these selectable inputs, corresponding filter coefficients are stored (e.g., in memory) and may be retrieved by multiplexer 152 and/or multiplexer 162 of configurable HR filter 126. In this example, filtering associated with four portions of BTSC compressor 30 is selectively performed by configurable IIR filter 126, however, in other arrangements, more or less filtering operations of the compressor may be performed by the configurable IIR filter. Additionally, configurable IIR filter 126 also provides a multiplication function via multiplier 138 and output registers 170 (shown in FIG. 5). Thereby, the operations of multipliers 54 and 62 may each be provided configurable IIR filter 126.

Figure 8:
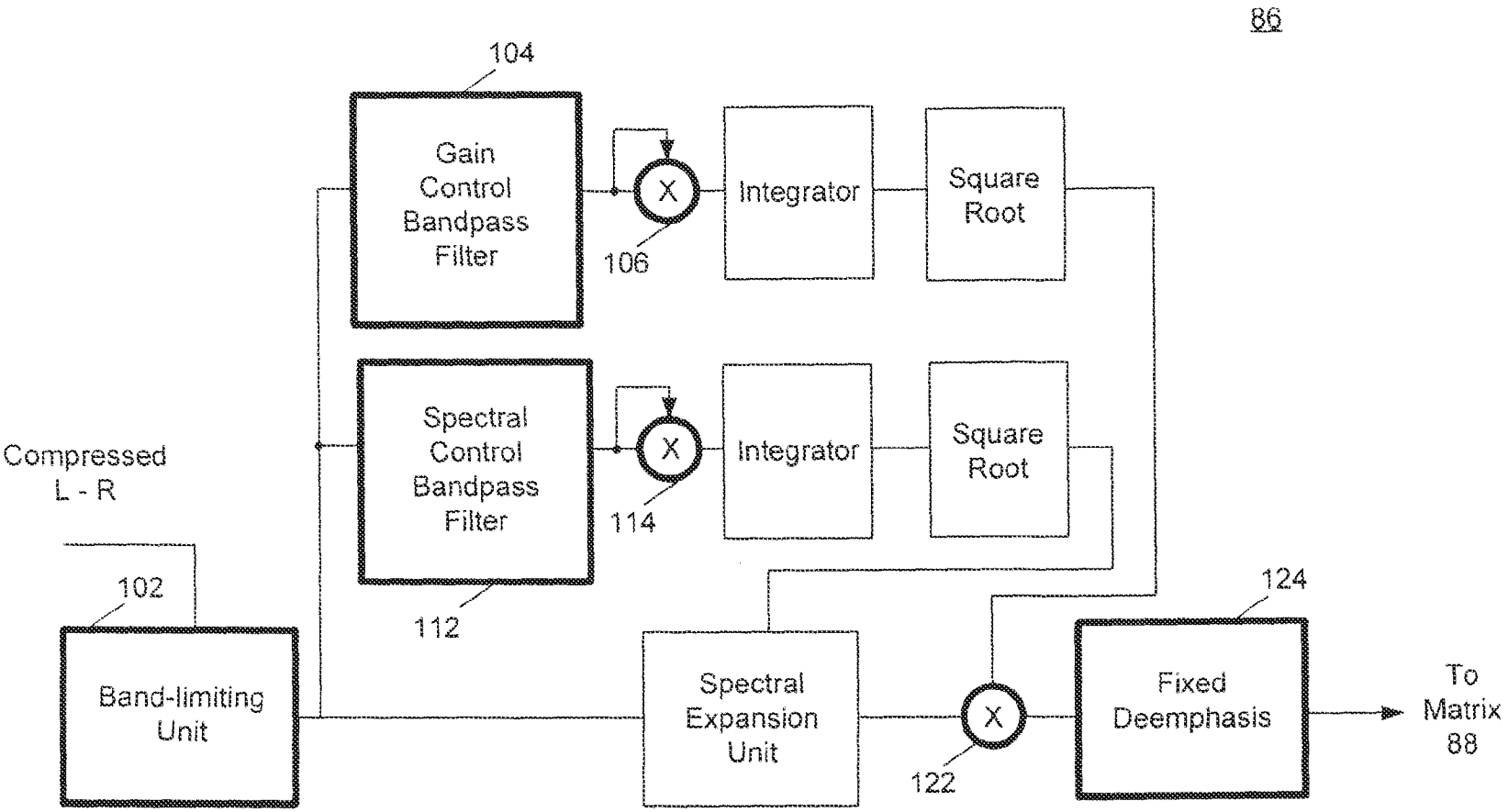
FIG. 8 is a block diagram of a portion of a BTSC decoder that highlights operations that may be performed by the configurable infinite impulse response filter shown in FIG. 5.

Referring to FIG. 8, portions of BTSC expander 86 are highlighted to identify filtering operations that may be performed by one or more configurable HR filters that may be implemented with configurable HR filter 126. For example, filtering associated with band-limiting unit 102 may be performed by configurable IIR filter 126. In particular, an input of multiplexer 130 may be assigned to band-limiting unit 102 such that when the input is selected, appropriate filtering coefficients are retrieved and used by configurable IIR filter 126. Similarly, filtering associated with gain control bandpass filter 104 (assigned to another input of multiplexer 130), spectral control bandpass filter 112 (assigned to another input of multiplexer 130), and fixed de-emphasis unit 124 (assigned to a still another input of selector 130) is consolidated into configurable IIR filter 126. Additionally, due to its multiplication function, configurable IIR filter 126 may provide the multiplication function for one or more of multipliers 106, 114, and 122.

While the previous example described using configurable IIR filter 126 with BTSC encoders and BTSC decoders, encoders and decoders that comply with television audio standards may implement the configurable IIR filter. For example, encoders and/or decoders associated with the Near Instantaneously Companded Audio Multiplex (NICAM), which is used in Europe, may incorporate one or more configurable IIR filters such as IIR filter 126. Similarly, encoders and decoders implementing the A2/Zweiton television audio standard (currently used in parts of Europe and Asia) or the Electronics Industry Association of Japan (EIA-J) standard may incorporate one or more configurable IIR filters.

While the previous example described using configurable IIR filter 126 to encode and decoder a difference signal produced from right and left audio channel, the configurable IIR filter may be used to encode and decode other audio signals. For example, configurable IIR filter 126 may be used to encode and/or decode an SAP channel, a professional channel, a sum channel, or one or more other individual or combined types of television audio channels.

A number of implementations have been described. Nevertheless, it will be understood that various modifications may be made. Accordingly, other implementations are within the scope of the following claims.

What is claimed is:

1. A television audio signal encoder, comprising:

a matrix device configured to sum a left channel audio signal and a right channel audio signal to produce a sum signal, and to subtract one of the left and right audio signals from the other of the left and right signals to produce a difference signal, wherein the device is configured to run at a clock speed;

a compressor configured to filter the difference signal to suppress noise; and a configurable infinite impulse response digital filter configured to run at a clock speed faster than the clock speed of the compressor, and to selectively use, over a sampling period, at least one set of filter coefficients to filter the difference signal, wherein the set of filter coefficients is applied to the difference signal by a single multiplier in a recursive manner to prepare the difference signal for transmission.

2. The television audio signal encoder of claim 1, wherein the configurable infinite impulse response digital filter includes a feedback path to apply the set of filter coefficients to the difference signal in a recursive manner.

3. The television audio signal encoder of claim 2, wherein the feedback path includes a shift register to delay digital signals associated with the difference signal.

4. The television audio signal encoder of claim 1, wherein the configurable infinite impulse response digital filter is configured to multiply a signal associated with the difference signal and provide an output of this multiplication.

5. The television audio signal encoder of claim 1, where the configurable infinite impulse response digital filter includes a selector configured to select a digital input signal.

6. The television audio signal encoder of claim 1, wherein the configurable infinite impulse response digital filter includes a selector configured to select one of the filter coefficients.

7. The television audio signal encoder of claim 5, wherein the selector includes a multiplexer.

8. The television audio signal encoder of claim 1, wherein the configurable infinite impulse response digital filter is configured to provide a low pass filter.

9. The television audio signal encoder of claim 1, wherein the configurable infinite impulse response digital filter includes a single adder for applying the filter coefficients to the difference signal in a recursive manner.

10. The television audio signal encoder of claim 1, wherein the television audio signal complies to the Broadcast Television System Committee (BTSC) standard.

11. The television audio signal encoder of claim 1, wherein the television audio signal complies to the Near Instantaneously Companded Audio Muliplex (NICAM) standard.

12. The television audio signal encoder of claim 1, wherein the television audio signal complies to the A2/Zweiton standard.

13. The television audio signal encoder of claim 1, wherein the television audio signal complies to the EIA-J standard.

14. The television audio signal encoder of claim 1, wherein the configurable infinite impulse response digital filter is implemented in an integrated circuit.

15. A television audio signal encoder for processing a left channel audio signal and a right channel audio signal and including signal paths requiring a plurality of filters for use at various stages of signal processing, wherein the encoder comprises:

a matrix arrangement configured to sum a left channel audio signal and a right channel audio signal to produce a sum signal, and to subtract one of the left and right audio signals from the other of the left and right signals to produce a difference signal;

a compressor configured to filter the difference signal to suppress noise; and at least one infinite impulse response digital filter configured to run at a clock speed faster than the clock speed of the compressor, wherein the infinite impulse response digital filter:

is reconfigurable during processing of the left channel audio signal and the right channel audio signal, includes a first signal selector for selectively receiving input signals to at least two of the filters for separately processing each of the input signals in accordance with a respective filtering operation, and a second signal selector for receiving signals representing sets of filter coefficients each corresponding to one of the respective one of the filter operations; and wherein the selectors are used to select at any one time the input signal and the corresponding set of filter coefficients applied to the input signal in a recursive manner by the infinite impulse response digital filter so that the infinite impulse response digital filter can selectively perform each of the filtering operations of at least two of the filters during processing of the left channel audio signal and the right channel audio signal.

16. The television audio signal encoder of claim 15, wherein each of the selectors is a signal multiplexer.

17. The television audio signal encoder of claim 16, wherein input signals to the first selector relate to the difference signal, and the reconfigurable infinite impulse response digital filter includes a feedback path to apply each set of filter coefficients to the corresponding input signals relating to the difference signal in a recursive manner.

18. The television audio signal encoder of claim 17, wherein the feedback path includes a shift register to delay signals related to the difference signal.

19. The television audio signal encoder of claim 17, wherein the reconfigurable infinite impulse response digital filter is configured to multiply each input signal relating to the difference signal and provide an output of this multiplication.

20. The television audio signal encoder of claim 17, wherein at least one of the filter operations provided by the reconfigurable infinite impulse response digital filter is that of a low pass filter.

21. The television audio signal encoder of claim 17, wherein the configurable infinite impulse response digital filter includes a single adder for applying the filter coefficients to the difference signal in a recursive manner.

22. The television audio signal encoder of claim 17, wherein the television audio signal complies to the Broadcast Television System Committee (BTSC) standard.

23. The television audio signal encoder of claim 15, wherein the television audio signal complies to the Near Instantaneously Companded Audio Muliplex (NICAM) standard.

24. The television audio signal encoder of claim 15, wherein the television audio signal complies to the A2/Zweiton standard.

25. The television audio signal encoder of claim 15, wherein the television audio signal complies to the EIA-J standard.

26. The television audio signal encoder of claim 15, wherein the configurable infinite impulse response digital filter is implemented in an integrated circuit.

* * * * *